United States Patent [19]

Wahnschaff

[11] 4,263,869

[45] Apr. 28, 1981

[54] GLUE APPLICATOR

[76] Inventor: Paul Wahnschaff, 3202 Marjan Dr., Atlanta, Ga. 30340

[21] Appl. No.: 111,528

[22] Filed: Jan. 14, 1980

[51] Int. Cl.[3] ..... B05C 1/02

[52] U.S. Cl. ..... 118/249; 118/203; 118/245; 118/258; 118/261; 118/262

[58] Field of Search ..... 118/245, 262, 249, 203, 118/204, 261, 259, 258, 247; 101/247, 352; 15/256.51; 271/273, 274

[56] References Cited

U.S. PATENT DOCUMENTS

| | | | |
|---|---|---|---|
| 1,741,412 | 12/1929 | Federwitz | 118/70 |
| 1,822,466 | 9/1931 | Valdes | 118/262 |
| 2,028,878 | 1/1936 | Rider . | |
| 2,131,606 | 9/1938 | VonHofe | 118/262 |
| 2,303,513 | 12/1942 | Thresh | 118/262 X |
| 2,511,781 | 6/1950 | Minkow | 118/262 |
| 3,000,347 | 9/1961 | Schaefer | 118/245 |
| 3,097,968 | 7/1963 | Schaefer | 118/262 X |
| 3,718,115 | 2/1973 | Lee | 118/203 |
| 3,919,970 | 11/1975 | Spielvogel | 118/203 |
| 4,119,057 | 10/1978 | Wahnschaff | 118/203 |

*Primary Examiner*—John P. McIntosh
*Attorney, Agent, or Firm*—Jones, Thomas & Askew

[57] ABSTRACT

Wipers are mounted on the opposite ends of a cylindrical glue wetting roll which direct the glue adhering to and moving upwardly with the flat end surfaces of the glue wetting roll first inwardly toward the axis of rotation of the glue wetting roll and then back to the glue pan. The glue applicator roll which picks up the glue from the glue wetting roll includes a ceramic coating about its annular surface which is contacted by the sheet material to which the glue is applied and by the picker fingers which pick the sheets from the roll.

2 Claims, 6 Drawing Figures

GLUE APPLICATOR

BACKGROUND OF THE INVENTION

This invention relates to coating apparatus wherein a solid applicator contacts the work, with a cleaner for the applicator. More particularly, this invention relates to a glue applicator of the type used to apply liquid glue to sheet material, such as to blanks which are ultimately formed into paper boxes.

Prior art glue applicator equipment has been developed for the purpose of feeding sheets of material in sequence to a series of processing stations and coating the sheets of material with glue and other liquids at one or more of the processing stations. These machines typically include equipment for picking off the end sheet from a stack of material, feeding the sheet along a path generally parallel to the plane of the sheet material into contact with the cylindrical surface of a rotating cylindrical glue applicator roll, picking the sheet off the glue applicator roll and passing the sheet to various subsequent work stations. The glue applicator roll continuously rotates in contact with a glue wetting roll which is partially submerged in a body of liquid glue or other liquid. The liquid is transferred from the body of liquid glue by the wetting roll to the applicator roll, and then to the sheet material. As a system operates, the liquid glue tends to accumulate and to harden on the various parts of the processing equipment, particularly on the end portions of the glue wetting roll. The accumulation of glue at the ends of the glue wetting roll is undesirable, particularly because an accumulation of glue tends to interfere with the proper continuous operation of the equipment.

Various wiper blades and other devices have been used in the past to scrape or wipe glue from the ends of cylindrical rolls. For example, my previous U.S. Pat. No. 4,119,057 illustrates a wiper for wiping the end surfaces of a glue applicator roll. Since the glue wetting roll is partially submerged in the liquid glue in the glue pan, the ends of the glue wetting roll become coated with glue, and a large amount of glue must be wiped or otherwise removed from the ends of the wetting roll. If the glue is allowed to accumulate without removal on the ends of the wetting roll, the build-up of glue eventually obstructs the operation of the equipment. Moreover, when the glue is wiped from the ends of the glue wetting roll, it is important that all of the glue be wiped from the end of the roll, without leaving any annular bands of glue passing between the wiper and the end surface of the wetting roll. If such annular bands of glue are permitted to remain on the ends of the wetting roll, these bands eventually become hard, they increase in size, and they tend to cut into the material of the wiper, thus tending to destroy the wiper.

When the glue is transferred from the wetting roll to the glue applicator roll, substantially the entire surface of the glue applicator roll is coated with glue. When the sheet material moves into contact with the glue applicator roll, usually the sheet material is of less width than the length of the glue applicator roll, and therefore contacts only the central portion of the glue applicator roll. After the sheet material contacts the glue applicator roll it tends to cling to the applicator roll until it is picked off the applicator roll by picks, whereupon the sheet material is diverted toward a subsequent processing station. The picks must be positioned in sliding contact with the glue applicator roll, usually in the middle portion of the glue applicator roll so as to make contact with the sheet material. Thus, as the machine operates, the glue applicator roll eventually becomes worn more in its central portion than at its end portions, causing a slight reduction in diameter about its central portion. The reduced diameter at the central portion of the applicator roll causes the roll to apply an uneven coating of glue on the sheet material. Thus, it is important that the glue applicator roll be fabricated from material that does not deteriorate rapidly from the continuous contact by the pickers and sheet material.

SUMMARY OF THE INVENTION

Briefly described, the present invention comprises a glue applicator assembly for a gluer which has improved wipers for the glue wetting roll and an improved glue applicator roll. The wipers are mounted at opposite ends of the cylindrical glue wetting roll and are shaped and supported so as to wipe the flat end surfaces of the roll and to deflect the glue adhering to the end surfaces of the roll and moving upwardly with the roll inwardly toward the axis of rotation of the roll and ultimately back to the glue pan. The glue applicator roll is a cylindrical roll with enlarged end flanges, with a ceramic coating extending about the roll between its end flanges, with the ceramic coating having an outside diameter approximately equal to the outside diameter of the end flanges. The pickers of the glue applicator assembly make sliding contact with the ceramic coating of the glue applicator roll and the ceramic coating is longer along the length of the glue applicator roll than the width of the widest sheet material to be accommodated by the glue applicator assembly, thus assuring that the ceramic coating will form the wear surface of the glue applicator roll.

Thus, it is an object of this invention to provide an improved glue applicator for use in a gluer and the like in which the cylindrical glue applicator roll is fabricated with a ceramic coating that provides improved hardness and surface texture for the purpose of applying liquid glue to sheet material.

Another object of this invention is to provide a glue applicator which includes a glue wetting roll with wipers at its ends, with the wipers being arranged to deflect the liquid glue adhering to the flat end portions of the wetting roll first inwardly toward the axis of rotation of the wetting roll and then downwardly to the glue pan beneath the wetting roll.

Another object of this invention is to provide wipers for a glue wetting roll that prevent an accumulation of glue on the flat end surfaces of the glue wetting roll.

Another object of this invention is to provide an improved combination of elements in a glue applicator which prolongs the operation life of the glue applicator.

Other objects, features and advantages of the present invention will become apparent upon reading the following specification, when taken in conjunction with the accompanying drawings.

DETAILED DESCRIPTION

Figure 1:
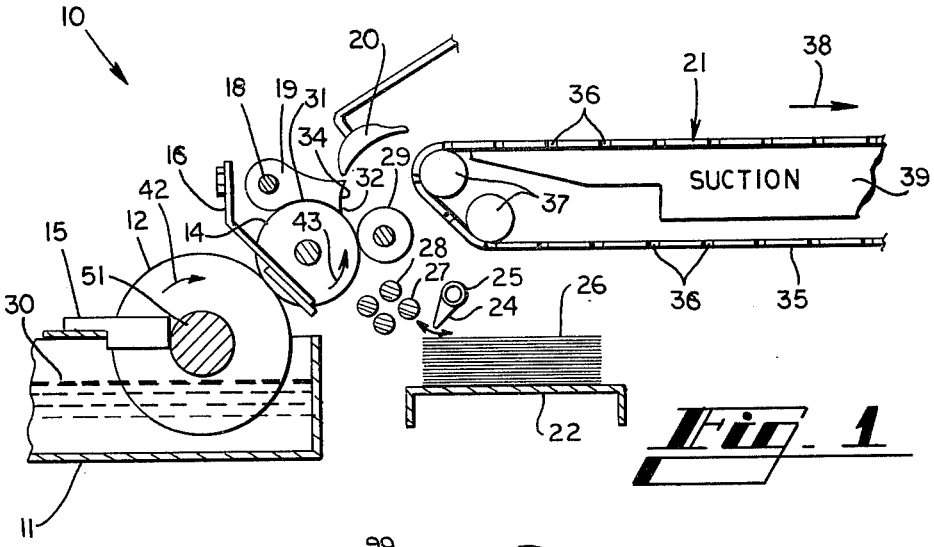
FIG. 1 is a schematic side elevational view of a portion of a glue applicator for applying glue to sheet material, showing the glue pan, glue wetting roll, glue applicator roll and their related components.

Referring now in more detail to the drawings, in which like numerals indicate like parts throughout the several views, FIG. 1 illustrates a portion of a gluer 10 which includes a glue supply pan 11, a cylindrical glue wetting roll 12, a cylindrical glue applicator roll 14, wetting roll wiper 15 at one end of the glue wetting roll 12, applicator roll wiper 16, pick finger support bar 18, a plurality of pick fingers 19, guide cams 20 and vacuum conveyor assembly 21. Supply platform 22 is located at an elevation lower than the cylindrical applicator roll 14 and is moved up and down, in timed relationship toward and away from the suction fingers 24. The suction fingers 24 are mounted on a suction tube 25 which oscillates or rotates in timed relationship with the system to pick up the uppermost sheet 26 from the platform 21 and move the uppermost sheet between one or more pairs of feed rolls 27 and 28. Drive means (not shown) drives rolls 12 and 14 and other elements of gluer 10. The sheets are directed between the glue applicator roll 14 and presser roll 29. The glue wetting roll 12 which is partially submerged in the liquid glue 30 in pan 11 rotates with a surface speed approximately equal to the surface speed of glue applicator roll 14 so as to wet the glue applicator roll with glue. When the sheet 26 passes in contact with the glue applicator roll 14, it becomes coated with glue.

The pick fingers 19 each include a curved lower edge 31 which is in close juxtaposition with respect to the upper curved surface of the cylindrical glue applicator roll 14, and a pointed end 32 which faces the oncoming sheet material. As the sheet material moves past the line of contact between the presser roll 29 and the glue applicator roll 14, the pointed ends of the pick fingers 19 tend to pick the leading edge of the sheet material away from the glue applicator roll 14, and the upwardly extending edge of each pick finger tends to deflect the oncoming edge of the sheet material upwardly toward the guides 20, and the guides 20 further deflect the sheet material on toward the suction conveyor 21. The upwardly extending edge 34 of each pick finger 18 as well as the contacting surfaces of the guides 20 are formed with a curvature that compliments the shape of the adjacent portion of the suction conveyor 21.

Suction conveyor 21 includes a conveyor belt 35 with a plurality of apertures 36 formed therein, and the belt moves about its rollers 37 in the direction indicated by arrow 38. A suction tray 39 is positioned immediately below the upper flight of the conveyor belt 35, and the inlet of a blower (not shown) communicates with the tray 39 so as to induce a flow of air through the upper flight of the conveyor, through the openings 36. This tends to cause the sheets of material being fed through the system to cling to the upper flight of the belt conveyor as the upper flight moves in the direction indicated by arrow 38, away from the gluer 10.

Figure 2:
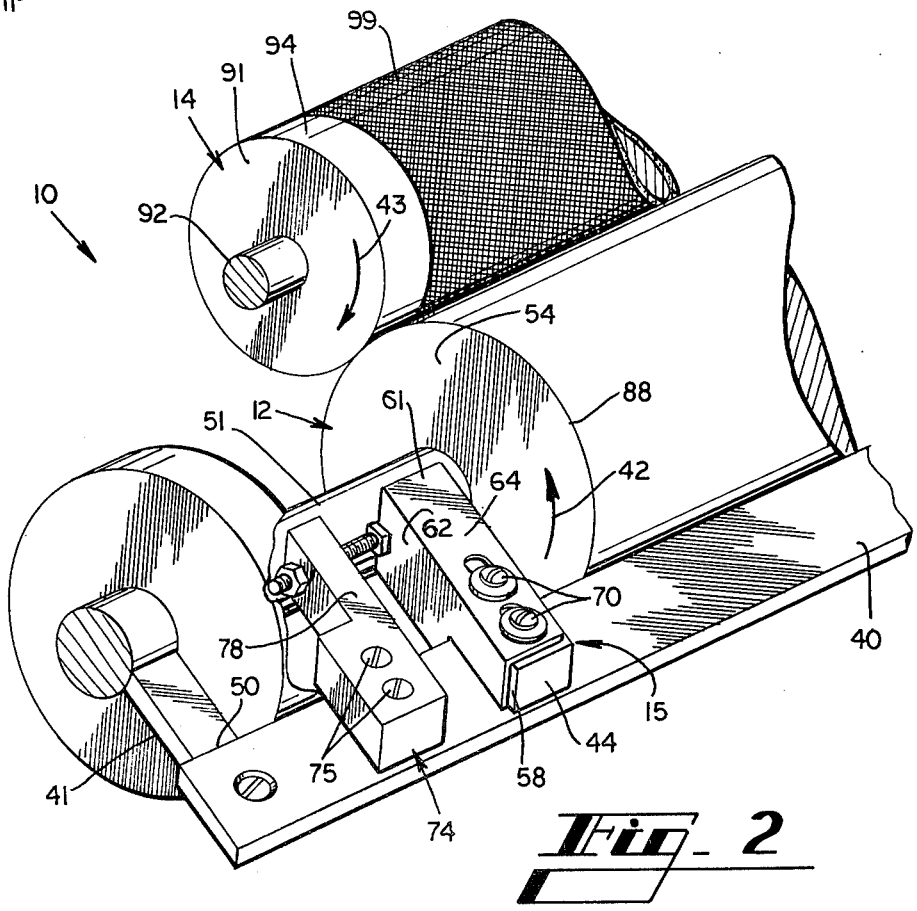
FIG. 2 is a partial perspective illustration of one end of the glue wetting roll and of the glue applicator roll and a wiper for the glue wetting roll.

As illustrated in FIG. 2, wherein one end of each of the glue applicator roll 14 and glue wetting roll 12 are illustrated, a wiper 15 is mounted to a metering blade 40. Metering blade 40 is mounted in parallel juxtaposition with respect to wetting roll 12 and is supported at its ends by brackets 41. As wetting roll 12 rotates in the direction indicated by arrow 42 and applies glue to the annular surface of applicator roll 14 which rotates in the direction indicated by arrow 43, metering blade 40 scrapes or "doctors" any excessive amount of liquid glue adhering to wetting roll 12 from the annular surface of the wetting roll.

Figure 3:
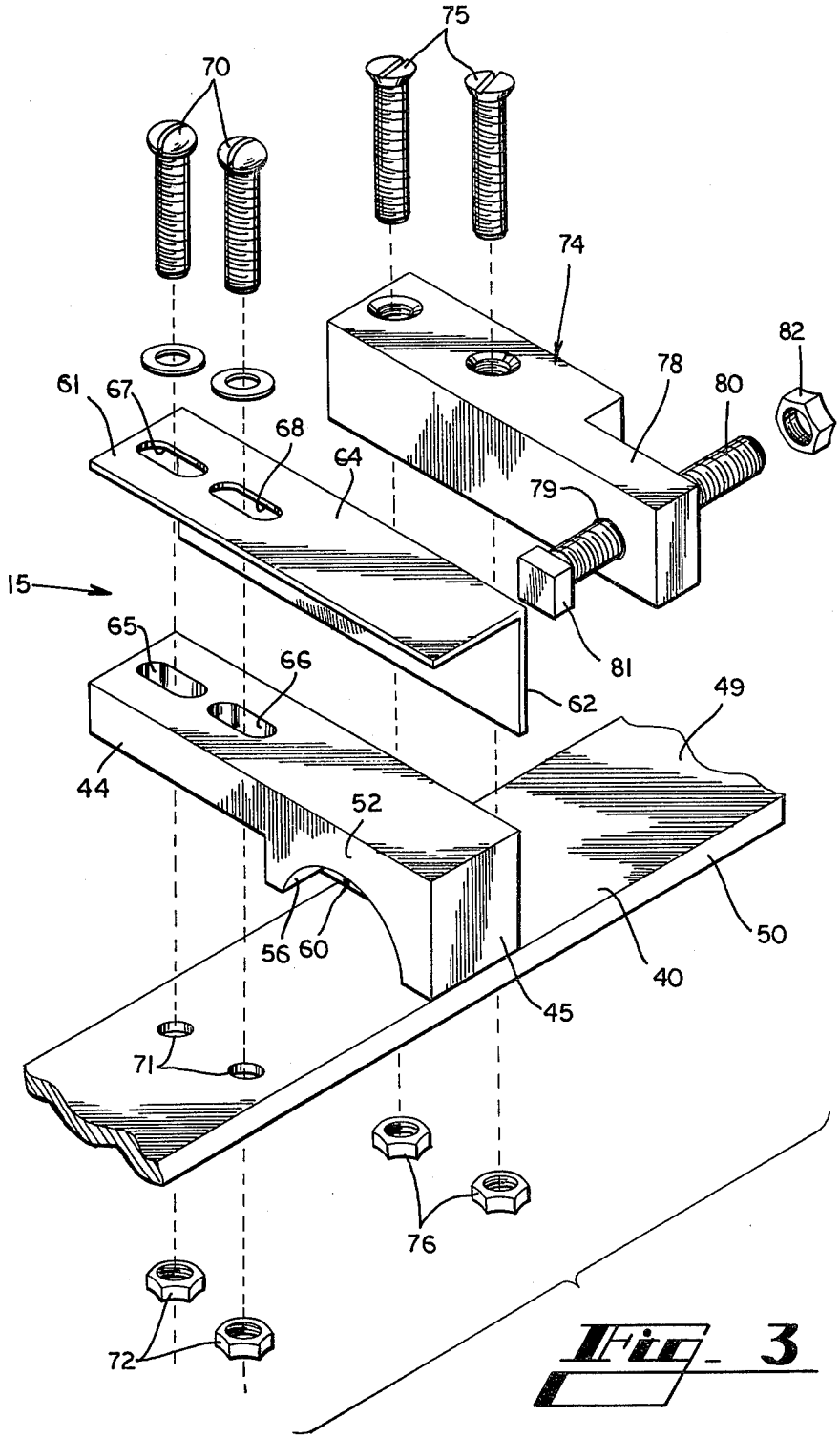
FIG. 3 is an exploded perspective illustration of a glue wiper.

Wiper 15 comprises a support leg 44 (FIGS. 3 and 4) and a wiping head 45. Support leg 44 is undercut so that its bottom surface 46 is located higher than the bottom surface 48 of wiping head 45, and support leg 44 is arranged to mount in flat abutment with the top surface 49 of metering blade 40. Wiping head 45 is arranged to hang over the edge 50 of metering blade 40 and project between metering blade 40 toward the shaft 51 of cylindrical wetting roll 15. Wiper 15 includes a substantially flat wiping surface 52 which abuts the substantially flat end surface 54 of wetting roll 12, and end surface 55, a bottom arcuate liquid deflecting surface 56, and a flat side surface 58 which is opposite to the wiping surface 52, and flat top surface 59. The bottom arcuate liquid deflecting surface 56 is cut upwardly from the projecting lower portion of wiping head 45, leaving a side wall 60 which is spaced from the flat end portion 54 of the wetting roll 12. Thus, side wall 60 overlies the concave arcuate liquid deflecting surface 56 of wiper 15. The end surface 55 of wiping head 45 is placed abutment with the annular surface of shaft 51.

Support bracket 61 is L-shaped and includes vertical side wall 62 and top wall 64. Top wall 64 abuts the top surface 59 of wiper 15 while side wall 62 abuts the flat side surface 58 of wiper 15. Elongated slots 65 and 66 are formed through support leg 44 of wiper 15, and elongated slots 67 and 68 are formed through top wall 64 of support bracket 61, with the slots 65 and 67 being alignable with one another and the slots 66 and 68 being alignable with one another. Mounting screws 70 project through slots 65–68 and through openings 71 in metering blade 40, and nuts 72 hold the mounting screws, wiper and support bracket on the metering blade 40.

A support block 74 (FIGS. 2 and 3) is also mounted on each end of metering blade 40 in spaced relationship with respect to a wiper 15. Mounting screws 75 extend through vertical openings of the support block and aligned openings in the metering blade 40 and nuts 76 fastened to the lower ends of screws 75 rigidly attach the support block to the metering blade, with the overhanging leg 78 projecting from the edge 50 of the metering blade toward shaft 51 of glue wetting roll 12. An internally threaded horizontally extending aperture 79 extends through support block 74, and externally threaded bearing screw 80 is threaded through the threaded opening 79. The head 81 of bearing screw 80 is arranged to abut the vertical side wall 62 of support bracket 61, and lock nut 82 is arranged to be threaded along bearing screw 80 until it abuts support block 74, thereby locking bearing head 81 in a fixed position. With this arrangement, support block 74 is used to apply side thrusting force against wiper 15, to cause the flat wiping surface 52 to be biased into engagement with the flat end surface 54 of the glue wetting roll 12.

Figure 4:
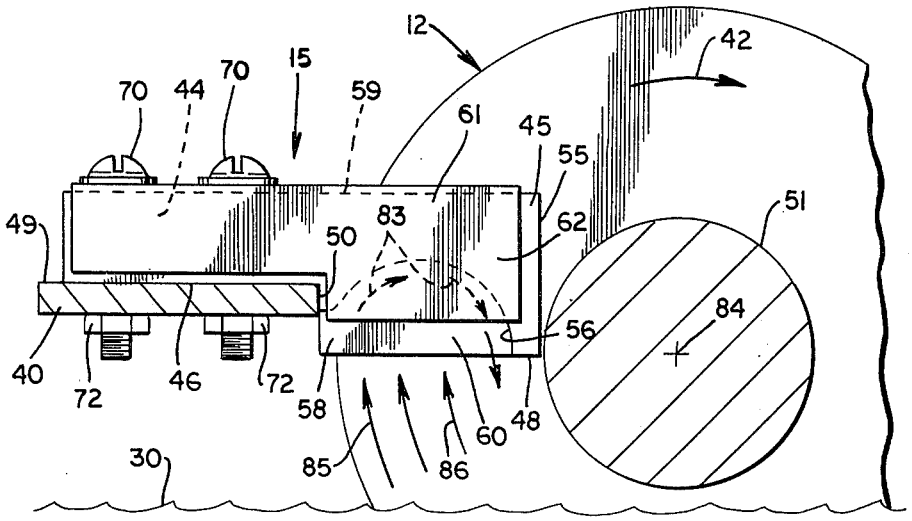
FIG. 4 is a side elevational view of a glue wiper, showing how the glue wiper is positioned with respect to one end of the glue wetting roll, and illustrating the flow of glue as it is wiped and deflected from the flat end surface of the glue wetting roll.
Figure 5:
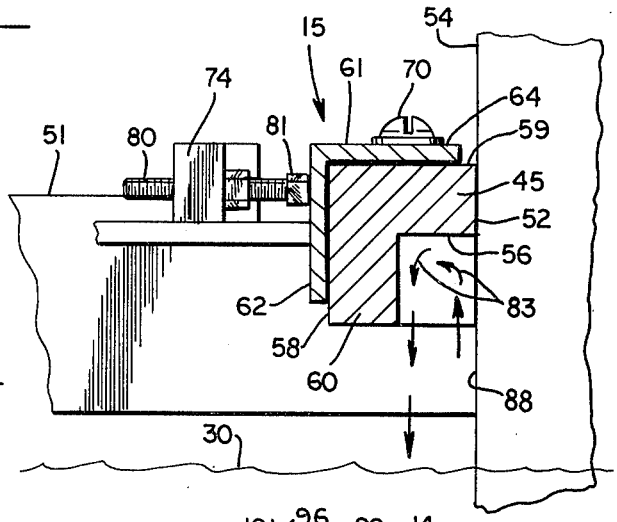
FIG. 5 is an end cross sectional view of a glue wiper, showing how the glue wiper is positioned with respect to one end of the glue wetting roll, and illustrating the flow of glue as it is wiped and deflected from the flat end surface of the glue wetting roll.

As illustrated in FIGS. 4 and 5, some of the glue from the body of glue 30 adheres to the flat end surface of the wetting roll 12. The glue that is located on the end surface of the roll which is further away from the axis of rotation 84 moves in an upward direction with greater velocity than the glue that adheres to the end surface at a location closer to the axis of rotation. For example, the glue moving upwardly at the location indicated by arrow 85 moves at a faster velocity than the glue moving at the location indicated at arrow 86. Moreover, the greater the distance from the axis of rotation on the flat end surface of the wetting roll, the greater the area on the end surface that is available for accumulating the glue. The net result is that when the glue adhering to the flat end surface of the wetting roll moves upwardly and reaches the concave liquid deflecting surface 56 of wiper 15, there is more volume of glue near the periphery of the end surface than at locations closer to the axis of rotation, and the velocity of the glue is greater near the periphery of the end surface than at locations closer to the axis of rotation 84, thus resulting in the glue tending to be turned by the concave liquid deflecting surface 56 toward the axis of rotation 84, and then back toward the body of glue 30 in the glue pan. This is indicated by flow arrows 83 in FIG. 4.

The concave liquid deflecting surface 56 is of a radius of curvature substantially less than the radius of curvature of the annular surface of the glue wetting roll 12. The concave deflecting surface 56 overlies the peripheral edge 88 of the flat end portion 54 of the wetting roll, and when the glue which is adhered to the flat end portion of the wetting roll is wiped from the wetting roll it tends to be deflected along the curvature of the concave deflecting surface 56, first somewhat upwardly along the direction of movement of the end surface of the wetting roll and then curled back toward the axis of rotation 84 of the wetting roll, and then back down toward the body of glue 30. As illustrated in FIG. 5, the movement of the deflected glue is also away from the surface 54 of the wetting roll.

Figure 6:
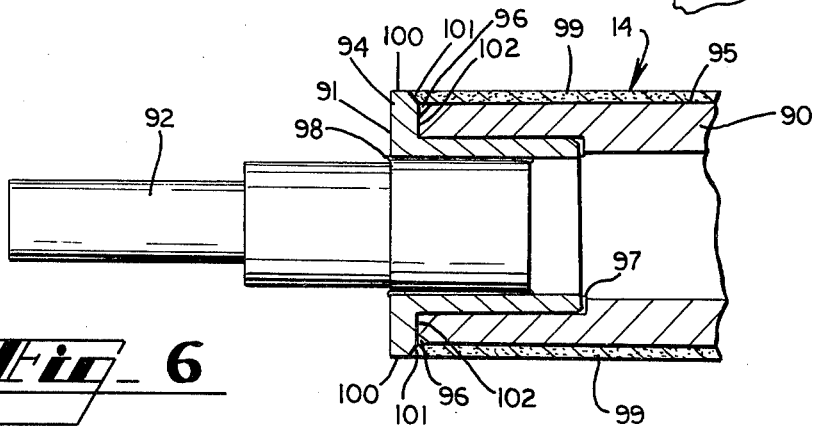
FIG. 6 is a cross sectional view of an end of the glue applicator roll through the longitudinal axis of the applicator roll.

As illustrated in FIG. 6, the applicator roll 14 is fabricated from a cylindrical core body 90, end plugs 91, and shafts 92. Each shaft is press fit into the opening of an end plug 91, and each end plug is press fit in an end opening of the core 90 at each end of the core. End plug 91 includes an enlarged annular flange 94 that protrudes beyond the annular surface 95 of core 90. The core 90 is welded at 96 with an annular weld to the protruding flange of end plug 91, and the shaft 92 is welded at 97 and 98 to the plug 91. An annular coating of hardened ceramic material 99 is formed on the outer annular surface 95 of core 90. The thickness of the ceramic material 99 is sufficient to bring the annular outer surface of the ceramic material even with the outer surface 100 annular flange 94 of plug 91. Annular flange 94 is beveled at 101 and the ceramic material fills the bevel 101. The metal plug 91 thus functions to close the end of the annular layer of ceramic material 99, with the bevel 101 and surface 102 helping to form a seal at the end of the ceramic material, to prevent entry of any caustic material beneath the layer of ceramic material and thus preventing deterioration of the ceramic material. Additionally, since the ceramic material 99 is more brittle than the metal of the plug 91, the plug functions to protect the end of the ceramic material 99 at the ends of the glue applicator roll 14. Thus, the ceramic material is less likely to become chipped or otherwise damaged because of impact or abrasion by other objects.

It should be understood, of course, that the foregoing relates only to the preferred embodiment of the present invention and that numerous modifications or alterations may be made therein without departing from the spirit and scope of the invention as set forth in the appended claims.

I claim:

1. In apparatus for applying glue and the like to sheet-like material comprising a rotatable cylindrical roll including an annular surface and substantially flat end surfaces with axle shafts extending coaxially from the flat end surfaces, means for rotating said roll about its longitudinal axis, means for applying liquid to said roll, a metering blade supported in parallel juxtaposition with respect to the annular surface of said cylindrical roll for removing excess liquid from said cylindrical roll, and means movable into contact with said roll whereby the liquid is transferred from said roll to rotates, the improvement therein comprising a wiper positioned at each end of said cylindrical roll with each wiper comprising a substantially flat wiping surface positioned beyond the metering blade and an arcuate liquid deflecting surface merging with said wiping surface, means for movably supporting each said wiper on said metering blade with its wiping surface urged in flat abutment with the end surface of said roll and extending from adjacent the axle shaft to beyond the periphery of the end surface of said roll with the arcuate liquid deflecting surface facing the on-coming portion of said end surface, said arcuate liquid deflecting surface comprising a concave surface with a radius less than the radius of the annular surface of said roll and overlying the periphery of the end surface of said roll and extending from the periphery of the end surface of the roll first generally along the direction of movement of the end surface and progressively curving toward the axis of rotation of said roll, whereby the liquid on the end surface of said roll is wiped from the end surface and deflected generally toward the axis of rotation of said roll, said means for movably supporting each said wiper comprising an L-shaped support bracket for each wiper, each said L-shaped support bracket including a side wall overlying the side of its wiper remote from said roll and a top wall overlying the upper portion of its wiper and each L-shaped support bracket being movably supported on said metering blade, and support means mounted on said metering blade adjacent each wiper and projecting beyond the metering blade in approximately parallel spaced relationship with respect to its wiper, and bearing means extending from each said support means for engaging the sidewall of said L-shaped support bracket and urging its wiper toward contact with the end surface of said roll.

2. The improvement of claim 1 and wherein said wiper further includes a wall portion spaced from and parallel to said wiping surface and overlying said concave surface.

* * * * *